United States Patent [19]

Poeschl et al.

[11] 4,175,677

[45] Nov. 27, 1979

[54] SELF-CONTAINED ACTUATION AND DETECTION DEVICE

[75] Inventors: Paul M. Poeschl, Marinette; David L. Stockwell, Waukesha, both of Wis.

[73] Assignee: The Ansul Company, Marinette, Wis.

[21] Appl. No.: 823,869

[22] Filed: Aug. 11, 1977

[51] Int. Cl.[2] ..... A62C 37/06

[52] U.S. Cl. ..... 222/5; 222/52; 169/20; 239/272

[58] Field of Search ..... 222/5, 52, 54; 169/20, 169/26; 116/103; 239/271, 272

[56] References Cited

U.S. PATENT DOCUMENTS

| | | | |
|---|---|---|---|
| 3,178,119 | 4/1965 | Thorson | 169/20 X |
| 3,584,688 | 6/1971 | Duncan et al. | 169/65 X |
| 4,064,944 | 12/1977 | McClure et al. | 169/20 X |

*Primary Examiner*—Stanley H. Tollberg
*Assistant Examiner*—Frederick R. Handren
*Attorney, Agent, or Firm*—Morgan, Finnegan, Pine, Foley & Lee

[57] ABSTRACT

A double ended piston assembly is maintained in a cocked position in a stepped piston chamber under the influence of pressurized sensor gas. Loss of pressure results in the pistons being driven to an actuating position wherein a puncture element carried thereby fractures a frangible disc in a high pressure gas container. High pressure actuating gas from the container is then routed by the device to operate a responsive device.

10 Claims, 5 Drawing Figures

SELF-CONTAINED ACTUATION AND DETECTION DEVICE

The present invention relates to the field of actuation and detection devices. More particulary, the present invention is related to means for detecting pressure loss in a first fluid and actuating a piercing element to release a second fluid from a high pressure container. The device is particularly adapted for fire detection systems.

BACKGROUND

The use of fire suppression and detection systems has become widespread in both industrial and residential fields. These systems are provided for fixed installation and mobile installation.

One method of detecting the presence of heat/fire is the use of tubing positioned in the area to be surveyed. Such tubing may be metal piping or plastic. When heat or fire is sensed, the integrity of the tubing, which contains a pressurized fluid, is interrupted either by a meltdown of the tube itself or a sensing element. The loss of pressure in the tube is thereafter utilized as a control variable for actuating warning devices, fire suppression systems and the like.

Certain criteria are desirable for the devices which sense the pressure loss in the surveillance tubing which have not altogether been met in the industry, particularly in mobile sensing systems. These criteria include: (a) the device should be fully self-contained and require no external power source; (b) the device should be able to sense a fire or high temperature condition and then actuate a fire suppression system; (c) the device should be fail-safe; that is, no part of the mechanism must be capable of preventing actuation in the event of a high temperature or fire condition; and (d) the device should be able to withstand the extreme shock and vibration of a mobile vehicle environment.

SUMMARY OF THE INVENTION

The present invention fulfills the desired criteria outlined above by providing a gas/spring operated device which is fail-safe.

The device includes a housing defining a central cavity having a stepped piston chamber at one end and a passageway at the opposite end. A double ended piston assembly is slidably operative in the piston chamber and carries a depending puncture element. The puncture element extends through said passageway to puncture the frangible disc in a high pressure gas container located at the end of the passageway. The device is cocked by pressurizing a small piston to raise the piston assembly and maintained in the cocked position thereafter by pressure on a larger piston.

Loss of pressure in the cavity resulting from the presence of heat or fire in a sensor line causes the pistons and puncture element to be driven into an actuation position to release high pressure gas. Sealing means are provided for segregating the device into high pressure and low pressure zones.

DETAILED DESCRIPTION OF A PREFERRED EMBODIMENT

Figure 1:
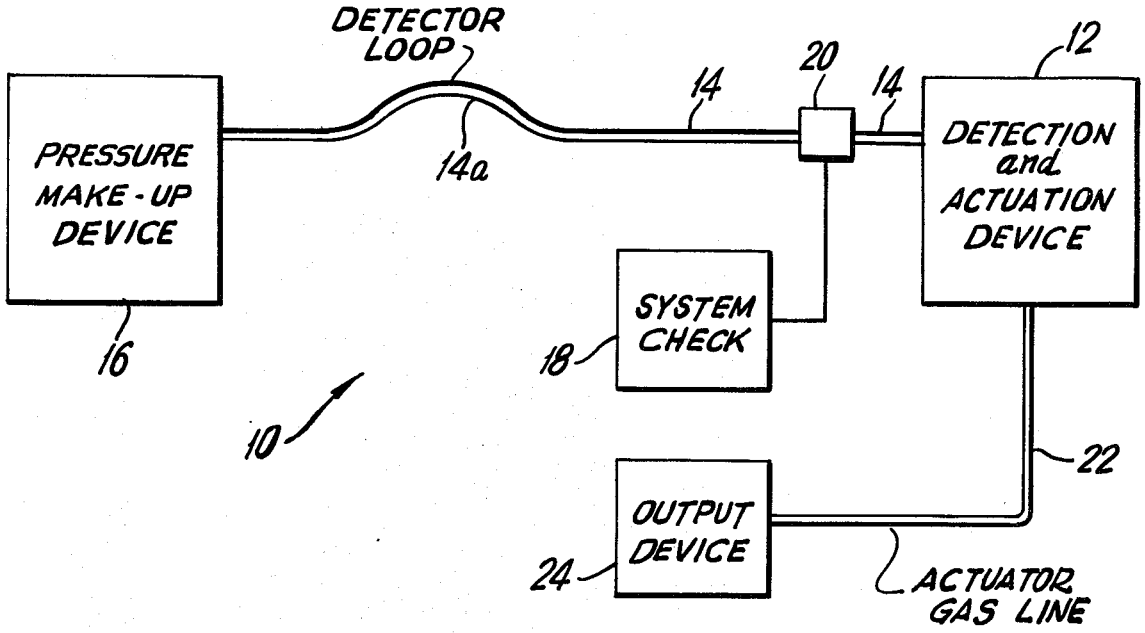
FIG. 1 is a schematic block diagram of a fire detection system incorporating a device of the present invention.

While this invention is suceptible of embodiment in many different forms, there is shown in the drawings and will hereinafter be described in detail a preferred embodiment of the invention, with the understanding that the present disclosure is to be considered as an exemplification of the principles of the invention and is not intended to limit the invention to the embodiments illustrated.

FIG. 1 illustrates a fire detection system 10 incorporating a self-contained actuation detection device 12 of this invention. The system includes detector tubing 14 having a detector loop **14*a* positioned in the fire hazard area, e.g. in the ceiling of a room or in the engine compartment of a vehicle. Tubing 14 is of a heat meltable type as is known in the art, e.g. nylon 11** plastic air tubing which is particularly adapted for high vibration environments.

One end of tubing 14 is connected to device 12, as explained in greater detail below. The tubing 14 is charged with a low pressure, 70 to 90 psig fluid, such as air or nitrogen. When heat or fire is present, the tubing 14 melts down resulting in a loss of pressure to the system.

Advantageously, the other end of the tubing is connected to a pressure make-up device 16 which provides a controlled amount of make-up fluid to compensate for any loss resulting from long term leakage. The device 16 thus assures that tubing 14 is always in the charged condition. However, the charging rate of device 16 is insufficient to make up for a gross loss of gas occurring when fire or heat is detected by the tubing.

Advantageously, the system also includes a system check assembly 18 to monitor the gas pressure in the tubing 14. A pressure switch 20 is located in the line of the tubing to provide a signal input to assembly 18. When the pressure in the tubing drops below a predetermined value, switch 20 closes, thereby providing a signal input to assembly 18. Assembly 18 may be one of any convenient warning devices such as a light or annunciator which will alert personnel of a loss in tubing pressure which has not been compensated for by make-up device 16.

Finally, the detection and actuation device 12 is connected by line 22 to an output device 24. As explained below, the output gas from device 12 is a high pressure gas, 900 to 1,800 psig, which is independent from the gas in tubing 14. The output gas is routed by line 22 to an output device which may be an annunciator and/or fire suppression system which is gas actuated, e.g. gas actuated dry chemical extinguishers located in the surveyed area.

Figure 2:
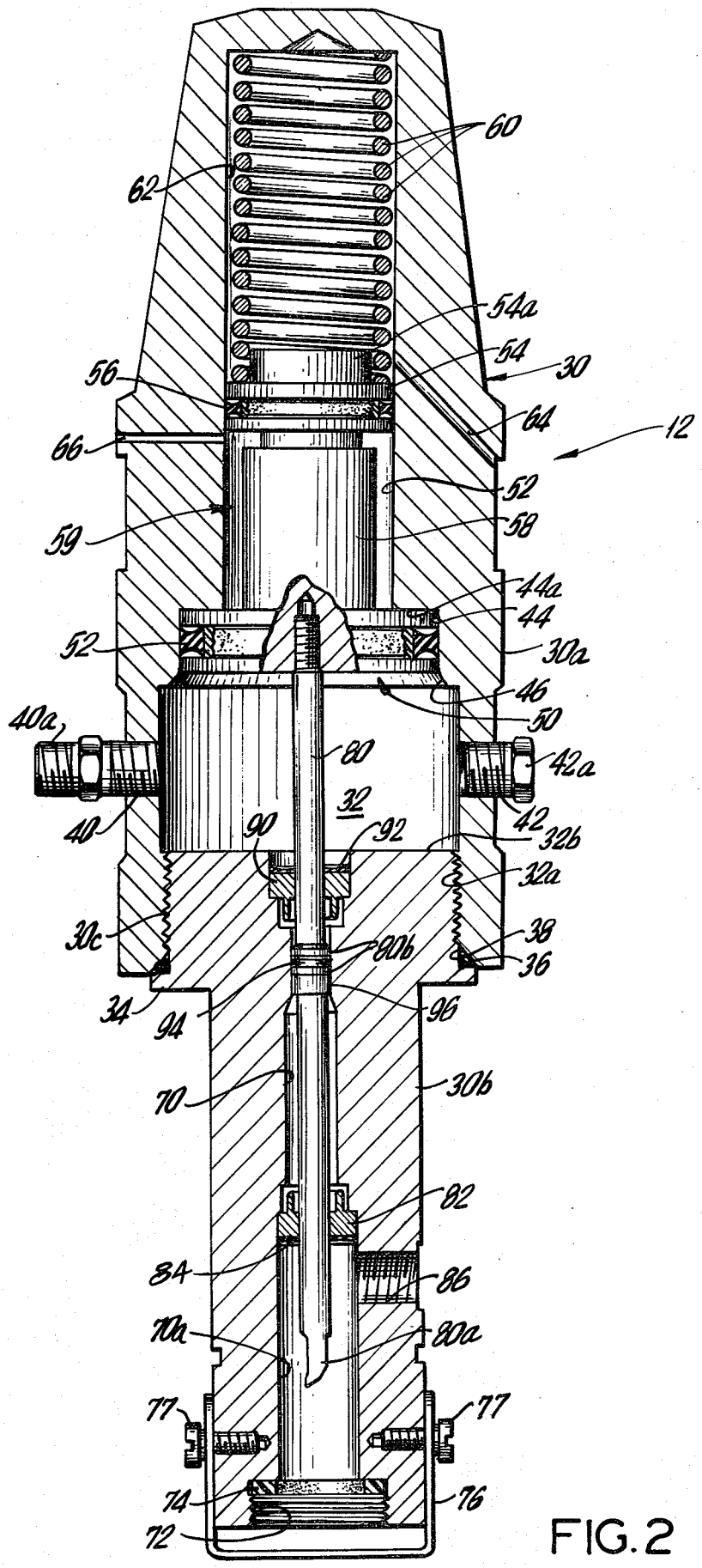
FIG. 2 is a longitudinal, sectional view illustrating a device of the present invention.

Referring now to FIG. 2, device 12 includes a hollow, two-piece housing 30 including a low pressure piece **30*a* and a high pressure piece 30*b***.

A low pressure cylindrical cavity 32 is located centrally of the housing at the bottom end of the low pressure piece **30*a*. The lower end of cavity 32 is threaded at 32*a* to threadably receive the upper end of the high pressure piece, which is also threaded at 30*c*. Piece 30*b* also includes an annular collar 34 which presses an O-ring 36 against a tapered edge 38 in piece 30*a*** to provide a seal therebetween.

Access ports 40 and 42 are provided in the wall of piece 30*a* to provide communication with the free space of cavity 32. Port 40 is provided with a fitting 40*a* which couples tubing 14 to cavity 32. A plug 42*a* is provided in port 42.

A first piston chamber 44 is provided above cavity 32 and in open communication therewith. The diameter of chamber 44 is smaller than the diameter of cavity 32 and is preferably interconnected therewith by a chamfered edge 46. Chamber 44 is axially aligned with cavity 32 and slidably receives a double faced or spool piston 50. A gasket 52 is carried on piston 50 to seal with the walls of chamber 44. Advantageously, the height of chamber 44 corresponds to the height of piston 50 so that the piston bottoms out against the top wall 44*a* of the chamber when it is received in the chamber and conversely a small downward movement of piston 50 results in unseating the piston from chamber 44.

A second piston chamber 52, smaller in diameter than chamber 44, is in axial alignment with chamber 44 and opens into it. Chamber 52 slidably receives a second double faced piston 54 which carries a gasket 56 between its faces.

Pistons 50 and 54 are interconnected by a reduced diameter member 58 to form a double ended piston assembly 59 for conjoint movement. A compression spring 60 is positioned in the upper end of chamber 52 and bears against the end thereof and the top of piston 54. A boss 54*a* is on the top of piston 54 to receive the end of spring 60. Spring 60 biases the piston assembly 59 in a downward direction to an actuation position.

FIG. 2 illustrates the device 12 in a charged condition, as explained below. The area 62 between the top of chamber 52 and the top of piston 54 is vented to atmosphere as by passage 64 so that only spring 60 opposes upward movement of the piston assembly 59. A second atmospheric vent 66 is provided in piece 30*a* and is positioned to vent the area between pistons 50 and 54, after the first piston 50 has sealed with chamber 44. In this manner, when the piston assembly is in the charged position, FIG. 2, the force of spring 60 is balanced only by the force on the lower surface of piston 50.

The high pressure piece 30*b* includes longitudinally and axially extending passageway 70 which opens into cavity 32 at one end and is threaded at its opposite end 72. Threaded end 72 is arranged to threadably receive a high pressure gas container C with a frangible disc D in its throat, see FIGS. 3–5. The neck of the container C is threaded into end 72 and is sealed therein by gasket 74. Advantageously, the neck of the container may also be secured to piece 30*b* by a collar assembly 76 fastened to the end of the piece by fasteners 77.

A rod 80 is threadably attached to piston 50 and extends axially therefrom through passageway 70. The lower or free end 80*a* of rod 80 includes a piercing element for fracturing the frangible disc D of the high pressure container C.

Passageway 70 is divided by a high pressure seal 82 and retainer 84, which slidably receive rod 80, to form a high pressure chamber 70*a* between seal 82 and the free end of the passageway. In this manner, high pressure gas from container C is confined to the high pressure chamber 70*a*. The high pressure gas, e.g. $CO_2$ or nitrogen, is vented through passage 86 into the actuator gas line 22.

A seal 90 and retainer 92 are also positioned in passageway 70 just below the cavity 32 to eliminate the flow of sensor gas from the cavity. Advantageously, the rod 80 also carries an O-ring 94 between two lands 80*b* on the rod. O-ring 94 seals in a throat portion 96 in the passageway 70 when the device is in the charged position to provide a double seal for sensor gas in cavity 32.

OPERATION

Figure 3:
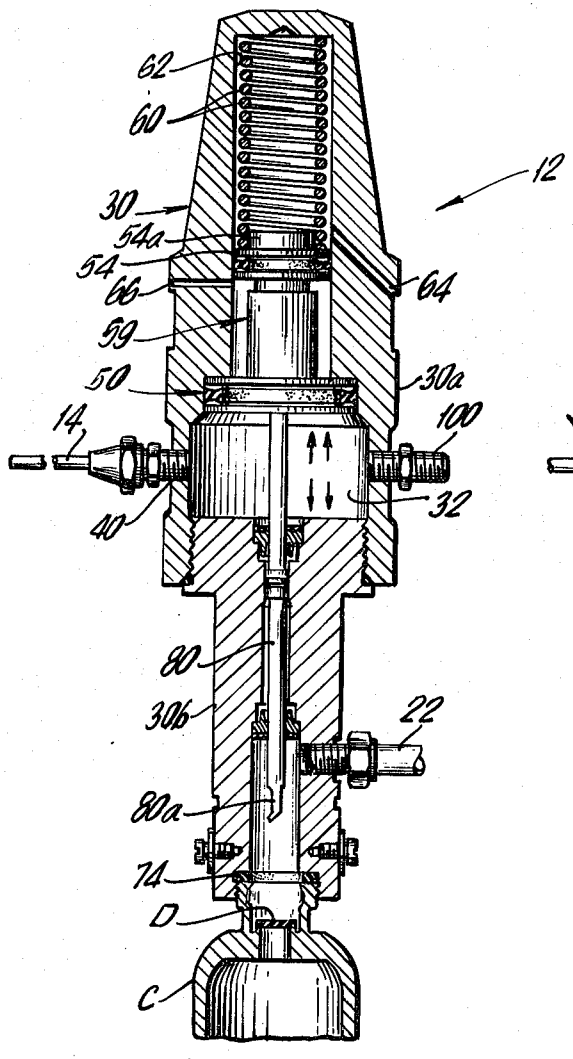

The operation of the device 12 will now be explained with reference to FIGS. 3–5. To activate the device, a fluid such as pressurized air is introduced into cavity 32, as through fitting 100. Initially, the double piston assembly 59 is in a down position, see FIG. 5, without the high pressure container C. The vertical distance between the bottom surfaces of pistons 50 and 54 is at least equal to the vertical distance between the floor 32*b* of cavity 32 and top 44*a*. Thus, piston 54 is always with chamber 52.

As the sensor gas is introduced into cavity 32, it charges the cavity and tubing 14. As the pressure in cavity 32 increases, the force on the lower surface of piston 54 overcomes the biasing force of spring 60, thus raising the piston assembly 59 and depending rod 80 to the charged position.

As the piston assembly rises, piston 50 seats within its chamber 44 and the gas pressure between the pistons is vented through port 66. The device 12 is thus in the charged or ready position. The container C is then threaded into the device and the system is fully operative.

Figure 4:
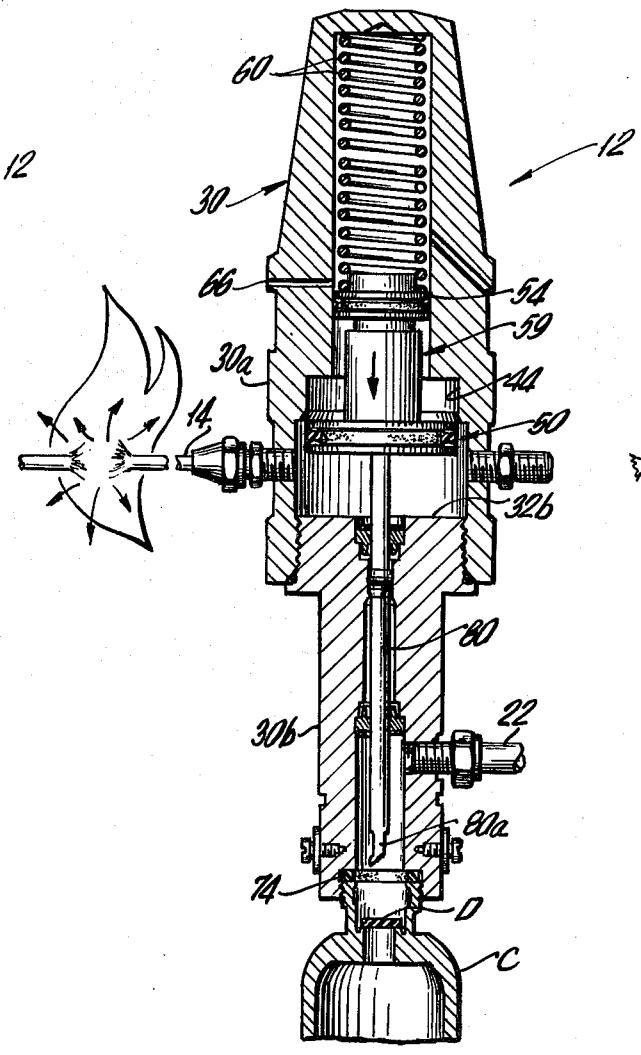

When tubing 14 bursts under the influence of high temperature (about 355° F.) or fire condition, the loss of pressure in the sensor gas results in a depressurization of cavity 32, FIG. 4. Spring 60 drives the piston assembly and puncture rod 80 downwardly causing the end of the rod to puncture disc D in the high pressure container C. The short vertical distance of chamber 44 results in rapid depressurization of any residual pressure in cavity 32. Thus, spring 60 is operative to generate an impulse in the downwardly moving assembly to fracture the disc.

Figure 5:
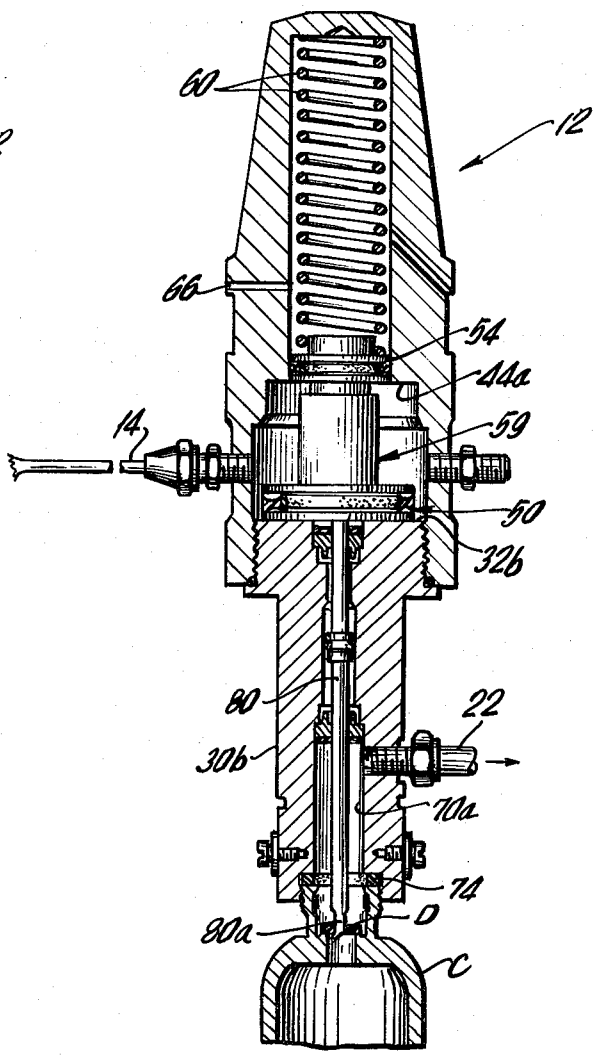
FIGS. 3, 4 and 5 are longitudinal sectional views illustrating the device of FIG. 2 in the charged, detection and actuation positions, respectively.

After the disc D has been ruptured, high pressure actuation gas flows from container C into the high pressure area 70*a* and out through line 22, FIG. 5. The high pressure gas in line 22 then operates an output device 24, which may be an alarm, gas actuated fire suppression system or the like.

Having explained the structure and operation of the device, other modifications will become apparent to those of skill in the art without departing from the scope and spirit of the present invention as pointed out in the appended claims.

We claim:

1. A self-contained detection and actuation device for use with a pressurized fluid container having a frangible disc comprising:

an elongate housing having a centrally located pressure cavity;

a first piston chamber adjacent said cavity with one end opening thereto, said first piston chamber having a diameter smaller than said cavity;

a second piston chamber axially aligned with said first piston chamber and having one end opening thereto, said second piston chamber being smaller in diameter than said first chamber;

a passageway extending axially from said cavity opposite said piston chambers;

means for coupling said pressurized container at the end of said passageway with said frangible disc presented thereto;

a double ended piston assembly including first and second pistons slidably received in said first and second piston chambers, respectively, and means interconnecting said pistons for conjoint movement;

means in said second piston chamber for biasing said piston assembly toward said cavity;

an elongate rod axially connected to said first piston and extending through said passageway, the free end of said rod having a piercing element thereon for puncturing said frangible disc when said piston assembly is moved by said biasing means;

sealing means for dividing said passageway into high pressure and low pressure portions; and means between said sealing means and said coupling means for withdrawing high pressure fluid from said high pressure portion of the passageway.

2. The device of claim 1, wherein the distance between said first and second pistons is at least equal to the throw of said piston assembly, whereby said second piston is always within said second piston chamber.

3. The device of claim 1, wherein the portion of said second piston chamber above the second piston is vented to atmosphere.

4. The device of claim 1, wherein said first piston chamber has a longitudinal length equal to the length of said first piston.

5. The device of claim 1, wherein means are provided in said second chamber for venting the area between said first and second pistons when said first piston is located within said first piston chamber.

6. A self-contained detection and actuation device for use in sensing a loss of pressure in a control volume and releasing fluid from a pressurized container having a frangible disc comprising:

housing means including a pair of stepped cylindrical piston chambers, the larger of said piston chambers opening into a cavity of larger diameter; means for coupling said cavity to the control volume to place said cavity in open communication therewith; a passageway extending axially from said cavity on the side opposite said pair of chambers; means for sealingly receiving said container with the frangible disc presented to the end of said passageway remote from the cavity;

a double ended piston assembly including a pair of axially spaced apart pistons slidably received in said pair of stepped piston chambers and a rod depending from said assembly and slidably received in said passageway, the free end of said rod being a piercing element for fracturing said disc;

means for sealingly dividing said passageway intermediate its length while permitting movement of said rod therethrough; conduit means in communication with said passageway between said sealing means and the end of the passageway;

said piston assembly being reciprocal between a first position wherein the pistons are received in their respective chambers and said piercing element is remote from said disc to second position wherein one of the pistons is in said cavity and the other is in its chamber and said piercing element driven through said disc; and means for biasing said piston assembly to said second position, whereby said assembly is moved to said first position by the presence of pressure in said control volume and driven to said second position by the loss of pressure in the control volume.

7. The device of claim 6, wherein said larger piston chamber has a length equal to the length of its associated piston.

8. The device of claim 7, wherein means are provided for venting the chamber area between said pistons when the assembly is in said first position.

9. The device of claim 6, wherein said stepped piston chamber is open to atmosphere at the end thereof remote from said cavity.

10. The device of claim 6, wherein said biasing means is a compression spring.

* * * * *